United States Patent [19]

Castanis

[11] 4,227,697

[45] Oct. 14, 1980

[54] WORD GAME APPARATUS

[76] Inventor: George Castanis, 444 6th Ave., New York, N.Y. 10011

[21] Appl. No.: 21,320

[22] Filed: Mar. 16, 1979

[51] Int. Cl.[3] ..... A63F 3/00

[52] U.S. Cl. ..... 273/272; 35/75

[58] Field of Search ..... 35/31 F, 35 G, 75; 273/155, 272, 299

[56] References Cited

U.S. PATENT DOCUMENTS

| | | | |
|---|---|---|---|
| 2,265,334 | 12/1941 | Armbruster | 273/299 |
| 2,848,824 | 8/1958 | Donaldson | 35/75 |
| 3,377,071 | 4/1968 | Treinis | 273/155 |
| 3,947,036 | 3/1976 | Kupec | 273/272 |
| 3,975,021 | 8/1976 | Brown | 35/31 F X |

FOREIGN PATENT DOCUMENTS

| | | | |
|---|---|---|---|
| 747598 | 4/1956 | United Kingdom | 273/272 |

OTHER PUBLICATIONS

Scrabble, p. 4 of Jan. 1956, Playthings Magazine.

*Primary Examiner*—Harland S. Skogquist

*Attorney, Agent, or Firm*—Michael Ebert

[57] ABSTRACT

Apparatus for playing a word game in which each player is supplied with a multi-channel slide holder having strips slidable therein. The channels of the holder all lie in parallel relation and are transversely bridged at the holder midpoint by a crosspiece having a column of read-out windows therein, each overlying a respective channel. Each strip is provided with a central blank zone and a series of letters printed on either side of the blank zone, the letters having numerical subscripts which assign values thereto. When all strips are aligned on the holder at their neutral positions, the blank zones thereof are displayed in all windows of the crosspiece. By shifting the strips in their channels in either direction, the player may select various letters for display in the windows of the column in a sequence creating a desired word. The letters of the several strips constitute a treasury containing all letters in the alphabet in a frequency depending on their usage in everyday words, the letters being inversely valued numerically by subscripts.

3 Claims, 4 Drawing Figures

W1
W2
W3
W4
W5
W6
W7
W8
W9
W10
1
2
3
4
5
6
7
8
9
10
11
12
13
SH
S1
S2
S6
E1 I1 X8 K6 A6 T1 V5 O1 D2 G4

WORD GAME APPARATUS

BACKGROUND OF INVENTION

This invention relates generally to apparatus for playing a word game, and more particularly to word game equipment which makes use of a multi-channel slide holder and slidable letter strips therein.

A written or printed word is composed of a series of letters which together constitute a spoken word. Each letter represents a unit of an alphabet and the individual letters or a combination thereof represent the sounds of consonants, vowels and syllables of human speech. In some languages, there is a direct and orderly phonetic correlation between the sound of a word and its spelling. Thus in German, words are generally spelled exactly as they sound, so that a student of German, once he acquires a knowledge of the relationship between letter combinations and sounds, is able without difficulty, upon hearing a German word, to spell it correctly.

But in English, a language which has evolved as an amalgam of several European languages, the relationship between the spelling and the phonetics of a spoken word is irregular and sometimes arbitrary. If, for example, one did not know how to spell "Worcestershire," and sought upon hearing this word, to then write it phonetically, the resultant written word would bear little resemblance to its correct form. And if one says the word "slay" without putting it in a sentence making its meaning clear, the auditor has no means of knowing whether to spell it as "slay" in the sense of kill, or "sleigh" in the sense of sled.

In acquiring a knowledge of the English language, an incredible amount of time is given over to proper spelling, and few students ever gain a sufficient mastery of the language to spell all words correctly. For example, there is no way from the sound of an English word having an "r," "p" or "s" sound to know whether to use a single or double letter to express this sound; and from an "f" sound to know whether to use the letter "f" or the letters "ph" for this purpose.

This problem has inspired word games and contests which through play and competition serve to implant in the players a knowledge of correct spelling and usage. The oldest game of this type is the spelling bee in which players compete in spelling spoken word. But the very term "spelling" denotes the formation of words from letters according to accepted usage, and what constitutes such usage is often in dispute.

In recent years, word games such as "Scrabble" have been invented to facilitate the acquisition of words and their correct spellings. In these games, players assemble letters on racks or other holding devices to create words, the letters being assigned different weights or values. By totalling the values forming an assembled word, one is able to score the players.

SUMMARY OF INVENTION

In view of the foregoing, the main object of this invention is to provide a word game apparatus making it possible for a player to select letters from a treasury thereof to create words.

More particularly, it is an object of this invention to provide an apparatus of the above type in which the letters in the treasury are not on separate pieces which must be located and placed on a rack or otherwise assembled into words, but are stored on a common slide holder or letter bank so that the letters are readily accessible for selection and assembly into words.

Briefly stated, these objects are attained in an apparatus for playing a word game in which each player is supplied with a multi-channel slide holder having strips slidable therein. The channels of the holder all lie in parallel relation and are transversely bridged at the holder midpoint by a crosspiece having a column of read-out windows therein, each overlying a respective channel. Each strip is provided with a central blank zone and a series of letters printed on either side of the blank zone, the letters having numerical subscripts which assign values thereto.

When all strips are aligned on the holder at their neutral positions, the blank zones thereof are displayed in all windows of the crosspiece. By shifting the strips in their channels in either direction, the player may select various letters for display in the windows of the column in a sequence creating a desired word. The letters of the several strips constitute a treasury containing all letters in the alphabet in a frequency depending on their usage in everyday words, the letters being inversely valued numerically by subscripts.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figures 1, 2, 4:
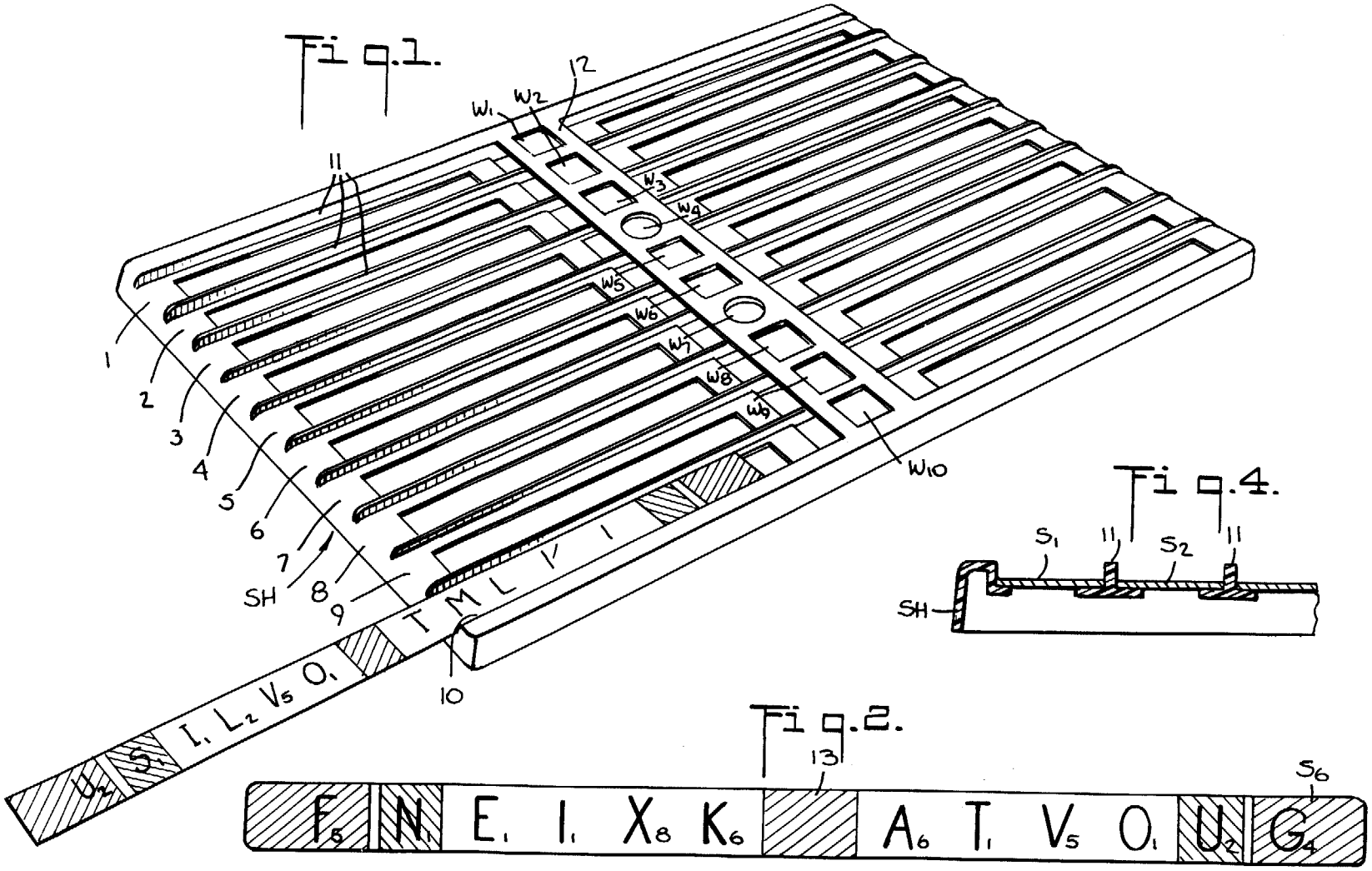
FIG. 1 is a muti-channel slide holder included in a word play apparatus in accordance with the invention.
FIG. 2 is a plan view of one of the strips slidable in a channel of the holder.
FIG. 4 is a transverse section taken in the plane indicated by line 4—4 in FIG. 3.

Referring now to FIG. 1, there is shown a multi-channel slide holder, generally designated by symbol SH for a word play apparatus in accordance with the invention. The holder is molded of a high-strength synthetic plastic material such as polyvinyl chloride or polycarbonate to define, in the embodiment shown, ten channels in parallel relation numbered 1 to 10. The boundaries of the channels are defined by parallel ridges 11.

Transversely bridging channels 1 to 10 at the midpoint of the holder is a crosspiece 12 having formed therein a column of read-out windows $W_1$ to $W_{10}$, each window overlying the correspondingly numbered channel. It will be seen that all windows other than windows $W_4$ and $W_7$ have a square formation, windows $W_4$ and $W_7$ being circular.

Slidable in channels 1 to 10 are strips $S_1$ to $S_{10}$ preferably formed of cardboard, whose widths are slightly narrower than the width of the channels, so that each strip is slidable in its channel. One may therefore readily switch the positions of the strips in the channels. Each strip, as exemplified by strip $S_6$ in FIG. 2, has a blank central zone 13 which in the neutral position of the strip in the channel is at the midpoint of the channel and is displayed in the channel window. Hence when all strips are in alignment at their neutral positions, all blank zones thereof are displayed in the windows $W_1$ to $W_{10}$ of the column and the word read-out is blank.

Printed on each strip on one side of blank zone 13 is a series of six letters, each having a numerical subscript. In the case of strip $S_6$, this series of letters is composed of $F_5$, $N_1$, $E_1$, $I_1$, $X_8$ and $K_6$. The other side of the blank zone is also provided with a series of six letters which in the case of strip $S_6$ is $A_6$, $T_1$, $V_5$, $O_1$, $U_2$ and $G_4$. Thus each strip carries twelve letters and a blank zone.

Since in the embodiment illustrated there are ten strips each carrying twelve letters, the resultant treasury contains one hundred and twenty letters. The frequency of a given letter in the treasury depends on its usage in everyday words, the letter being numerically valued in inverse relation to its frequency. Thus "A" appears ten times in the treasury and is assigned in a low value of 1, where "F" appears three times and is given a medium value of 5, whereas "Z" and "Q" appear only once and are each given a high value of 10.

In the strip, some letters appear on differently colored backgrounds and most others on a white background. Thus in strip $S_6$, letters F, N, U and G are on different colored grounds, whereas the others are on plain grounds.

Figure 3:
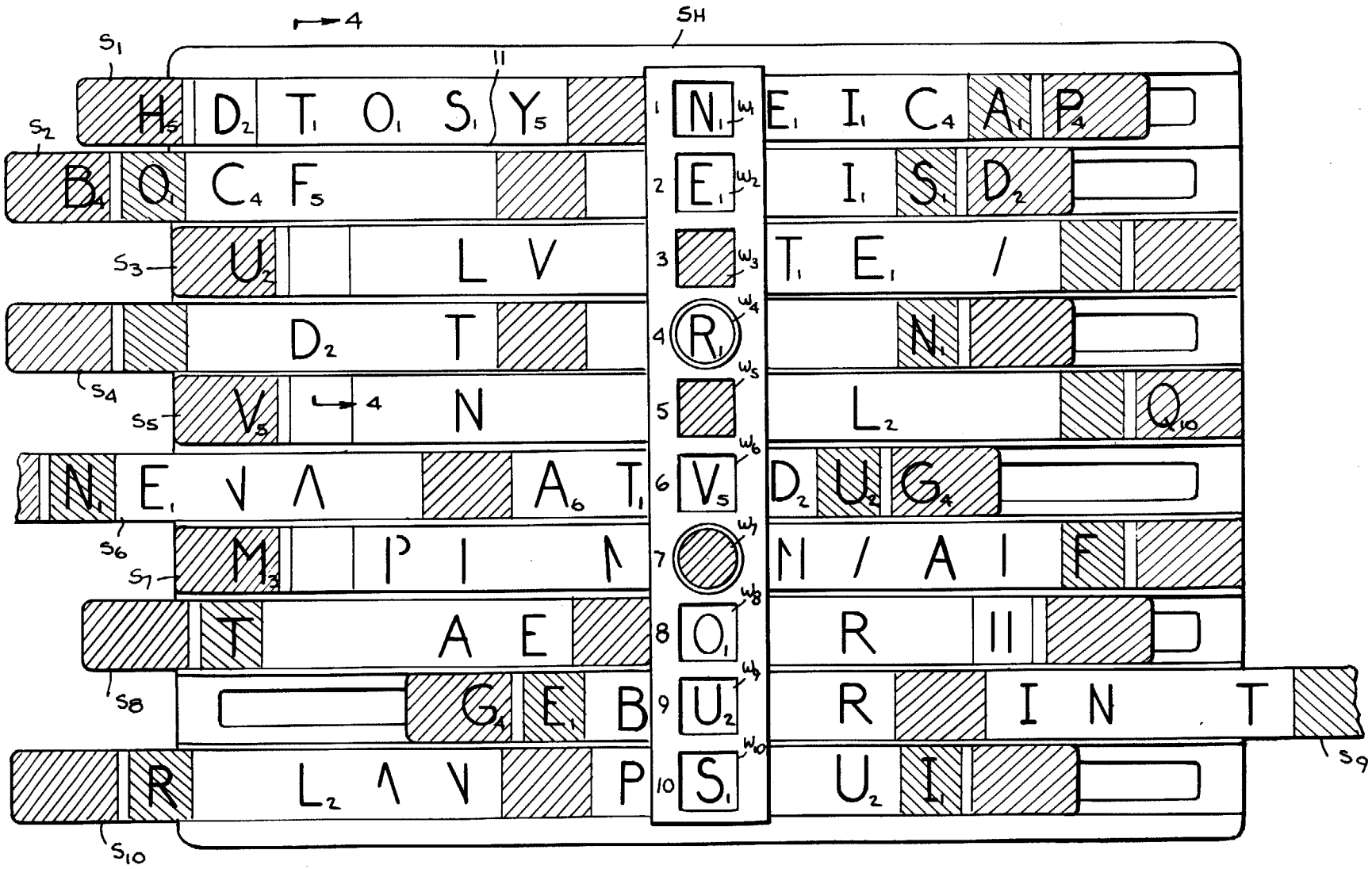
FIG. 3 is a plan view of the holder with strips therein, some of which are in their neutral position and others in an adjusted position.

In creating a desired word, the letters thereof are assembled in the read-out windows of the column by shifting the strips relative to the column to display the selected letters. Thus in FIG. 3, the word NERVOUS is formed by displaying "N" in channel 1, "E" in channel 2, "R" in channel 4, "V" in channel 6, "O" in channel 8, "U" in channel 9 and "S" in channel 10, the other channels having their strips in the neutral position to present a blank.

While the invention is not concerned with the particular rules of the word game but only with the structure of the apparatus therefor, we shall now show how this apparatus can be used to play a word game in which each player (2 to 4) is provided with a slide holder and a set of strips are illustrated.

The object of this word game is to complete an incomplete sentence with a word of the highest possible point value. A deck of Activity Cards is provided, the top line of which directs the player to switch two lines on the player's slide holder. The rest of the card consists of four incomplete sections. Thus a typical Activity Card reads as follows on one side:

Switch lines 7 and 8

1. Jack be nimble, Jack be _____.
2. If the shoe fits, _____ it.
3. I'll make a _____ out of you yet, barked the Sergeant.
4. Speaking of _____, that reminds me of a joke, quipped the comedian.

In playing, the Activity cards are shuffled, and a player is selected to read the top card. The reader announces the line switch. Each plays on his own slide holder, then reverses the two appropriate letter strips. The reader then reads the appropriate sentence on the card.

A game consists of a number of rounds. A round is the completion of a single sentence. During each round of the first game, the reader reads sentence #1 on each card. During each round of the second game, the reader reads sentence #2 on each card, etc. The reader then places the card on the bottom of the pile.

The player on his slide holder tries to create a single word that somehow completes the sentence that was just read; the created word running from the top to the bottom of the read-out column. Thus CAT can be created by a "C" in line 2, an A in line 8 and a T in line 10, all other channel lines being blank. If, for example, the sentence to be completed were "It was raining cats and _____," some players might use "DOGS" to complete the sentence; but such words as "MICE" and "MONEY" would be just as acceptable and might earn a higher score. Since there are ten read-out windows, this permits the formation of large words. Obviously, the concept underlying the invention encompasses slide holders with more than ten lines and with strips with more than twelve letters.

The base score is the total number of points that appear on the letters that appear in the read-out column to which the added bonus points determined by the colors of the presented letters and by whether the window is square or round.

While there has been shown and described a preferred embodiment of a word game apparatus in accordance with the invention, it will be appreciated that many changes and modifications may be made therein without, however, departing from the essential spirit thereof.

I claim:

1. Word game apparatus comprising:

(A) a multi-channel slide holder of synthetic material having open channels which lie in parallel relation and are transversely bridged at the holder midpoint by a narrow crosspiece having a read-out column of windows therein, each window overlying a respective channel; and (B) a strip formed of cardboard having a length substantially equal to the length of the slide holder slidable in each channel of the holder and provided with a series of letters which are exposed in said open channels and are in a non-alphabetical sequence, a letter being selected for display through the channel window by shifting the strip relative to the crosspiece, some of said windows having a circular formation and others a square formation for purposes of scoring bonus points, said letters on the strips together constituting a treasury containing all letters in the alphabet in a frequency depending on their usage in everyday words, each letter being valued numerically by a subscript inversely with respect to its frequency.

2. Apparatus as set forth in claim 1, wherein each strip is provided with a blank central zone whereby when all strips are aligned in their neutral position, said column of windows displays only blanks.

3. Apparatus as set forth in claim 1, wherein some of the letters on each strip are printed on different colored grounds.

* * * * *